US009404458B2

(12) United States Patent
Kamada et al.

(10) Patent No.: US 9,404,458 B2
(45) Date of Patent: Aug. 2, 2016

(54) FUEL INJECTION VALVE DAMPING INSULATOR

(75) Inventors: Akira Kamada, Toyota (JP); Tomokazu Sumida, Akaiwa (JP); Seizou Watanabe, Akaiwa (JP)

(73) Assignees: TOYOTA JIDOSHA KABUSHIKI KAISHA, Aichi-ken (JP); UCHIYAMA MANUFACTURING CORP., Okayama-shi (JP)

( * ) Notice: Subject to any disclaimer, the term of this patent is extended or adjusted under 35 U.S.C. 154(b) by 459 days.

(21) Appl. No.: 14/113,671

(22) PCT Filed: Apr. 25, 2012

(86) PCT No.: PCT/IB2012/000810

§ 371 (c)(1),
(2), (4) Date: Oct. 24, 2013

(87) PCT Pub. No.: WO2012/146971

PCT Pub. Date: Nov. 1, 2012

(65) Prior Publication Data

US 2014/0048044 A1 Feb. 20, 2014

(30) Foreign Application Priority Data

Apr. 27, 2011 (JP) ..... 2011-099703

(51) Int. Cl.
*F02M 61/14* (2006.01)
*F02F 11/00* (2006.01)

(52) U.S. Cl.
CPC ..... *F02M 61/14* (2013.01); *F02F 11/00* (2013.01); *F02M 2200/85* (2013.01); *F02M 2200/858* (2013.01)

(58) Field of Classification Search
CPC ... F02M 61/14; F02M 61/167; F02M 61/168; F02M 69/042; F02M 2200/858; F02M 2200/09; F02M 2200/85; F02M 2200/852; F02M 2200/853; F02M 2200/16; F02F 11/11
USPC ..... 123/470; 239/533.11; 277/598, 591, 277/313, 593
See application file for complete search history.

(56) References Cited

U.S. PATENT DOCUMENTS 4,402,773 A * 9/1983 Morrill ..... E21B 33/047 285/123.12
5,752,487 A * 5/1998 Harrell ..... F02M 55/025 123/470

(Continued)

FOREIGN PATENT DOCUMENTS

DE 10025984 B4 * 7/2014 ..... F02M 61/14
JP 4191734 B2 9/2008

(Continued)

*Primary Examiner* — Lindsay Low
*Assistant Examiner* — George Jin
(74) *Attorney, Agent, or Firm* — Sughrue Mion, PLLC

(57) ABSTRACT

A fuel injection valve damping insulator damps vibration produced in a fuel injection valve (11). A damping insulator (30) is interposed between a shoulder portion (18) of a cylinder head and a tapered surface (24) of the fuel injection valve (11) that faces the shoulder portion. The damping insulator (30) includes an annular tolerance ring (33) that abuts against the tapered surface (24), and an elastic member (36) that is arranged between the tolerance ring (33) and the shoulder portion (18). An annular coil spring (34) and a sleeve (35) are each embedded juxtaposed in the elastic member (36). A height (H2) of the sleeve (35) is formed lower than an outer diameter (H1) of individual small ring portions that form a helix of the coil spring (34), and at least one of a tolerance ring (33) side and a shoulder portion (18) side of the sleeve (35) is buried in the elastic member (36).

8 Claims, 6 Drawing Sheets

(56) References Cited

U.S. PATENT DOCUMENTS 5,823,446 A * 10/1998 Bennett ..... F02M 51/0667 239/585.1
6,640,784 B1 * 11/2003 Sims, Jr. ..... F02M 55/025 123/456
8,069,842 B2 * 12/2011 Kannan ..... F02M 55/004 123/470
8,528,524 B2 * 9/2013 Hofmann ..... F02M 61/14 123/470
8,714,139 B2 * 5/2014 Holt ..... F02M 61/14 123/470
2003/0201612 A1 * 10/2003 Neumaier ..... F02M 61/14 277/591
2004/0020470 A1 * 2/2004 Norgauer ..... F02M 61/14 123/470
2004/0040543 A1 * 3/2004 Mickelson ..... F02M 61/14 123/470
2004/0060544 A1 * 4/2004 Reiter ..... F02M 61/14 123/470
2004/0194764 A1 * 10/2004 Okajima ..... F02M 61/14 123/469
2005/0066941 A1 * 3/2005 Berger ..... F02M 61/14 123/470
2007/0175451 A1 * 8/2007 Beardmore ..... F02M 61/14 123/470
2007/0228662 A1 * 10/2007 Reiter ..... F02M 61/14 277/313
2008/0000452 A1 * 1/2008 Ricci ..... F02M 61/14 123/470
2010/0154746 A1 * 6/2010 Fischer ..... F02M 61/14 123/456
2011/0067653 A1 * 3/2011 Clark ..... F02F 1/242 123/41.31
2011/0265767 A1 * 11/2011 Xu ..... F02M 53/046 123/470
2012/0138013 A1 * 6/2012 Solferino ..... F02M 61/14 123/294
2013/0014719 A1 * 1/2013 Sugiyama ..... F02M 61/14 123/188.1
2013/0167807 A1 * 7/2013 Kamada ..... F02M 61/14 123/470

FOREIGN PATENT DOCUMENTS

JP 2010-106758 A 5/2010
JP 2010-106759 A 5/2010
WO 2011/121728 A1 10/2011
WO 2012/014326 A1 2/2012

* cited by examiner

FUEL INJECTION VALVE DAMPING INSULATOR

BACKGROUND OF THE INVENTION

1. Field of the Invention

The invention relates to a fuel injection valve damping insulator that damps vibration produced in a fuel injection valve that injects fuel in an internal combustion engine.

2. Description of Related Art

Conventionally, in a so-called in-cylinder injection type internal combustion engine, that is a type of internal combustion engine in which fuel is injected into a combustion chamber, for example, a fuel injection valve is suspended between a cylinder head and a delivery pipe by having a portion toward a tip end of the fuel injection valve be inserted into and supported by an insertion hole of the cylinder head, and a portion toward the base end of the fuel injection valve be inserted into and supported by the delivery pipe (i.e., a fuel injection valve cup). Normally, in this kind of fuel injection valve, when fluctuations in the fuel pressure supplied via the delivery pipe occur due to the injection of fuel being started and stopped, vibration based on this fuel pressure fluctuation and operating vibration of the fuel injection valve occur. Therefore, a damping insulator that absorbs and suppresses vibration of the fuel injection valve is often installed between the fuel injection valve and the insertion hole of the cylinder head.

However, because the cylinder head and the delivery pipe are originally separate parts, the relative positions of these parts inevitably change due to tolerance related to machining and manufacturing of the parts, tolerance related to assembly during manufacture, and various vibrations and thermal deformation that occur with operation of the internal combustion engine, for example. That is, even with the fuel injection valve described above that is suspended between the cylinder head and the delivery pipe, the axis of the fuel injection valve becomes inclined with respect to the axis of the insertion hole of the cylinder head, and the fuel injection valve will become positionally offset at the position where it is supported by the cylinder head and the delivery pipe. This kind of positional offset may lead to a fuel leak by creating looseness in a portion of an O-ring that prevents fuel from leaking between the fuel injection valve and the delivery pipe (i.e., the fuel injection valve cup) or the like, at the base end side of the fuel injection valve.

Therefore, an insulator that aims to absorb and suppress vibration of a fuel injection valve, and reduce the effect from the axial inclination of the fuel injection has been proposed. The insulator described in Japanese Patent No. 4191734 is an example of one such insulator. The insulator described in Japanese Patent No. 4191734 includes an annular adjustment element 60 sandwiched between a shoulder portion 54 of a cylinder head 51 and a tapered stepped portion 57 of a fuel injection valve 55 that increases in diameter in a tapered shape so as to face the shoulder portion 54, as shown in FIG. 7. An injection nozzle 56 of the fuel injection valve 55 is arranged inserted through an insertion hole 52 (i.e., a receiving hole) of the cylinder head 51, and the shoulder portion 54 of the cylinder head 51 widens out to a side wall 53 of the insertion hole 52. The adjustment element 60 includes a first leg 61 that extends along the shoulder portion 54 of the insertion hole 52, and a second leg 62 that extends along the tapered stepped portion 57 of the fuel injection valve 55. The fuel injection valve 55 is configured to be elastically supported with respect to the cylinder head 51 by the first leg 61 surface-contacting the shoulder portion 54 of the insertion hole 52, and the second leg 62 surface-contacting the tapered stepped portion 57 of the fuel injection valve 55.

With this kind of insulator, during assembly, if an axis C2 of the fuel injection valve 55 becomes displaced between the insertion hole 52 of the cylinder head 51 and the delivery pipe, the first leg 61 will move along the shoulder portion 54 of the insertion hole 52 based on force generated by the second leg 62 that bends following the tapered stepped portion 57 of the fuel injection valve 55. As a result, the positional relationship of the fuel injection valve 55 with respect to the insertion hole 52 and the delivery pipe is able to be appropriately compensated for. However, when the internal combustion engine is operating, high pressure based on the fuel pressure described above is applied to the adjustment element 60 through the tapered stepped portion 57 of the fuel injection valve 55. At this time, the fuel injection valve 55 may no longer be able to elastically support the fuel injection valve 55 with respect to the cylinder head 51 due to metal fatigue from the fuel pressure accumulating in the adjustment element 60, or the adjustment element 60 plastic deforming as a result of the adjustment element 60 receiving unexpected pressure or the like. The position in the vertical direction of the fuel injection valve 55 that is no longer able to be elastically supported in this way with respect to the cylinder head 51 moves, so the fuel injection position will also change, and the like. As a result, an optimum combustion state may no longer be able to be maintained. Also, the adjustment element 60 that has lost is elasticity will transmit vibration produced by the fuel injection valve 55 based on the fuel pressure to the cylinder head 51 without damping it. As a result, noise due to the transmitted vibration may emanate from the internal combustion engine, and sensors of the internal combustion engine may erroneously detect the transmitted vibration as knocking, and the like.

SUMMARY OF THE INVENTION

In view of the foregoing problems, the invention thus provides a fuel injection valve damping insulator capable of suitably maintaining a fuel injection position of a fuel injection valve, as well as a damping function with respect to the fuel injection valve, when an internal combustion engine is operating.

Thus, a first aspect of the invention relates to a fuel injection valve damping insulator that damps vibration produced in a fuel injection valve. The fuel injection valve is installed in a cylinder head in a state inserted into an insertion hole provided in the cylinder head. A shoulder portion is formed widening out in an annular shape at an inlet portion of the insertion hole. The fuel injection valve includes a stepped portion in which a diameter thereof increases in a tapered shape so as to have a tapered surface that faces the shoulder portion. The damping insulator is interposed between the stepped portion and the shoulder portion. This damping insulator includes a tolerance ring that is an annular shape that abuts against the tapered surface, and an elastic member that is arranged between the tolerance ring and the shoulder portion. The elastic member is formed in an annular shape corresponding to a bottom surface of the tolerance ring to damp vibration produced in the fuel injection valve. A coil spring that is arranged in an annular shape corresponding to the annular shape of the elastic member, and an annular sleeve that is juxtaposed to the coil spring, are embedded in the elastic member. The sleeve is such that a height thereof is formed lower than an outer diameter of individual small ring portions that form a helix of the coil spring, and at least one of the tolerance ring side and the shoulder portion side of the sleeve is buried in the elastic member.

According to the structure of the fuel injection valve damping insulator described above, if the coil spring largely deforms from pressure or the like, such that the position of the fuel injection valve is maintained by the sleeve, at least one of the tolerance ring side and the shoulder portion side of the sleeve is buried in the elastic member, so the elastic member is interposed together with the sleeve between the fuel injection valve and the cylinder head. As a result, vibration transmitted from the fuel injection valve to the cylinder head via the sleeve can be reduced by the elastic member that is interposed midway along this path. That is, even if the coil spring largely deforms, the position of the fuel injection valve is able to be maintained by the sleeve, and vibration transmitted to the internal combustion engine is also able to be suppressed. As a result, even when the position of the fuel injection valve is maintained by the sleeve, vibration transmitted from the fuel injection valve to the internal combustion engine is suppressed, so noise that emanates from the internal combustion engine due to transmitted vibration is reduced, and erroneous detection by a knock sensor of the internal combustion engine of transmitted vibration as knocking and the like is suppressed.

Also, in the fuel injection valve damping insulator described above, a rigidity of the sleeve may be higher than a rigidity of the coil spring.

According to the structure of the fuel injection valve damping insulator described above, excessive deformation that leads to plastic deformation of the coil spring that may deform so much that it may undergo plastic deformation when it receives strong pressing force from the fuel injection valve can be reliably prevented. As a result, the damping characteristic of the damping insulator can be suitably maintained.

Also, in the fuel injection valve damping insulator described above, a height of the sleeve and a length of the outer diameter of the small ring portions are set to values at which plastic deformation of the coil spring and the elastic member will not occur with a deformation amount of equal to or less than a difference in length between a height of the sleeve and the outer diameter of the small ring portions before deformation, when the coil spring and the elastic member are deformed.

According to the structure of the fuel injection valve damping insulator described above, a height of the sleeve and a length of the outer diameter of the small ring portions are set to values at which plastic deformation of the coil spring and the elastic member will not occur with a deformation amount of equal to or less than the difference in length between a height of the sleeve and the outer diameter of the small ring portions before deformation, when the coil, spring and the elastic member have deformed as a result of receiving strong pressing force from the fuel injection valve, so plastic deformation will not occur if a normal pressing force is applied. Furthermore, if strong pressing force that may cause excessive deformation is applied, the sleeve that has a higher rigidity than the rigidity of the coil spring will receive the pressing force, so the coil spring and the elastic member will not plastic deform.

Also, in the fuel injection valve damping insulator described above, the coil spring and the sleeve may be maintained in a state in which the coil spring and the sleeve do not contact each other, and be embedded in the elastic member.

According to the structure of the fuel injection valve damping insulator described above, interference by the sleeve with respect to the coil spring is reduced. Accordingly, the possibility that the damping characteristic given to the coil spring will change due to interference by the sleeve is reduced. As a result, the damping characteristic of the damping insulator can be suitably maintained.

Also, in the fuel injection valve damping insulator described above, the sleeve may be positioned on an outer peripheral side of the coil spring.

According to the structure of the fuel injection valve damping insulator described above, the coil spring can be made smaller. Also, arranging the sleeve on the outside enables the size of the sleeve to be large enough so that it will not fall into the insertion hole of the cylinder head.

Also, in the fuel injection valve damping insulator described above, the tolerance ring side of the sleeve may be buried in the elastic member.

According to the structure of the fuel injection valve damping insulator described above, the elastic member is interposed between the sleeve and the tolerance ring. As a result, vibration transmitted from the fuel injection valve to the tolerance ring is transmitted to the sleeve after being suppressed by the elastic member. Thus, the transmission of vibration from the sleeve to the internal combustion engine is also suppressed, so the transmission of vibration from the fuel injection valve to the internal combustion engine is able to be suppressed even when the fuel injection valve is supported by the sleeve.

Also, in the fuel injection valve damping insulator described above, the shoulder portion side of the sleeve may be buried in the elastic member.

According to the structure of the fuel injection valve damping insulator described above, the elastic member is interposed between the sleeve and the shoulder portion. As a result, vibration transmitted from the fuel injection valve to the sleeve is transmitted to the shoulder portion after being suppressed by the elastic member. In this way, the transmission of vibration from the sleeve to the internal combustion engine is suppressed, so the transmission of vibration from the fuel injection valve to the internal combustion engine is able to be suppressed even when the fuel injection valve is supported by the sleeve.

Also, in the fuel injection valve damping insulator described above, the damping insulator may also include an annular metal plate interposed between the elastic member and the shoulder portion, and the metal plate may be configured to integrally sandwich the tolerance ring and the elastic member from an inner peripheral side of the tolerance ring.

According to the structure of the fuel injection valve damping insulator described above, the relative position, with respect to the elastic member, of the tolerance ring that is not easily strongly joined to the elastic member is determined from the inner peripheral surface by the plate. Accordingly, the tolerance ring is easily stacked appropriately on the elastic member, which enables the operability (i.e., the feasibility) of this kind of damping insulator to be improved.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
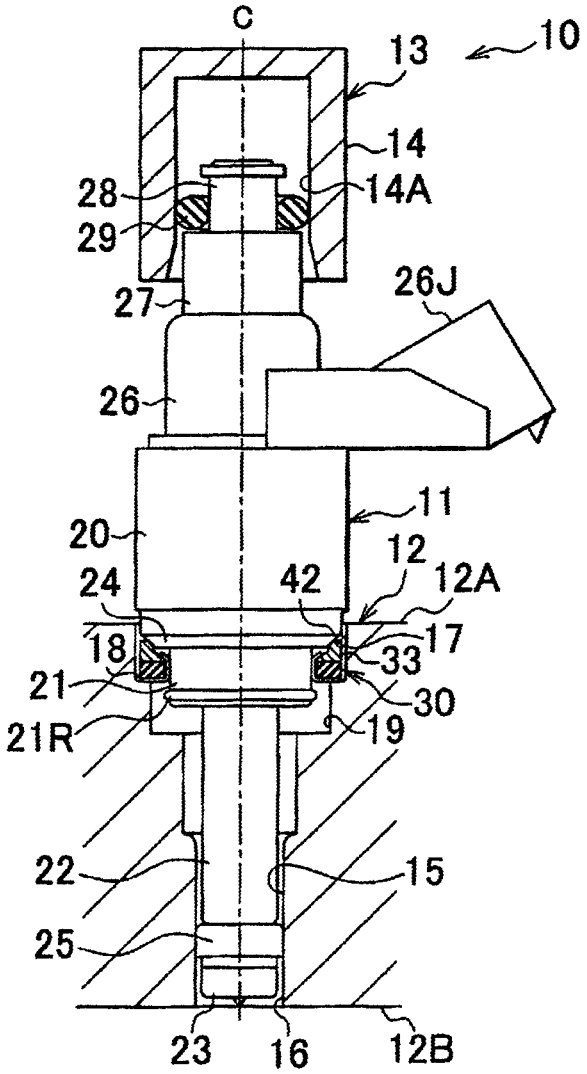
FIG. 1 is a view showing a frame format of an overview of a fuel injection apparatus to which a first example embodiment of a damping insulator according to the invention may be applied.

Hereinafter, a first example embodiment of the damping insulator according to the invention will be described with reference to FIGS. 1 to 4. As shown in FIG. 1, a fuel injection apparatus 10 is provided with a fuel injection valve 11. A portion toward a tip end (i.e., below in FIG. 1) of the fuel injection valve 11 is supported by being inserted through an insertion hole 15 of a cylinder head 12, and a portion toward a base end (i.e., above in FIG. 1) of the fuel injection valve 11 is supported by a fuel injection valve cup 14 of a delivery pipe 13. In this way, the fuel injection valve 11 is suspended between the cylinder head 12 and the delivery pipe 13.

The insertion hole 15 of the cylinder head 12 is formed extending through from an outer surface 12A of the cylinder head 12 to an inner surface 12B of the cylinder head 12, as a multi-stepped hole having a hole diameter that becomes successively narrower from the outer surface 12A of the cylinder head 12 (i.e., the upper side in FIG. 1) toward the inner surface 12B (i.e., the lower side in FIG. 1) that faces a combustion chamber of an in-cylinder injection type internal combustion engine. That is, the hole diameter of an inlet portion 17 of the insertion hole 15, that is an inlet that opens to the outer surface 12A of the cylinder head 12, is largest, and the hole diameter of a tip end hole portion 16 of the insertion hole 15 that opens to the inner surface 12B is smallest. As a result, a stepped portion based on the difference of these hole diameters is formed at the portion where the diameter of the insertion hole 15 changes, so a shoulder portion 18 as the stepped portion is formed between the inlet portion 17 and a mid-hole portion 19 that is connected to the inlet portion 17. That is, the shoulder portion 18 is formed in a way that makes an end portion on the outer surface 12A side of the mid-hole portion 19 widen out in an annular shape. The tip end hole portion 16 of the insertion hole 15 is communicated with an in-cylinder injection type combustion chamber, so an injection nozzle 23 of the fuel injection valve 11 is able to be inserted and fit into the tip end hole portion 16 of the insertion hole 15. As a result, the tip end hole portion 16 introduces high-pressure fuel injected from the injection nozzle 23 into the combustion chamber.

The delivery pipe 13 is designed to supply high-pressure fuel, of which the pressure had been accumulated to an injection pressure, to the fuel injection valve 11, so the delivery pipe 13 has the fuel injection valve cup 14 into which a base end portion of the fuel injection valve 11 is inserted and fit. When the base end portion of the fuel injection valve 11 is inserted into the fuel injection valve cup 14, a fuel seal between the base end portion of the fuel injection valve 11 and an inner peripheral surface 14A of the fuel injection valve cup 14 is ensured by an O-ring 29 arranged between the two.

The fuel injection valve 11 is designed to inject, at a predetermined timing, the high-pressure fuel supplied from the delivery pipe 13 into the combustion chamber that is formed by the cylinder head 12. A housing of the fuel injection valve 11 is formed in a multi-stepped cylindrical shape that becomes successively narrower from the center in the axial direction toward both the tip end side (i.e., the insertion hole 15 side) and the base end side (i.e., the fuel injection valve cup 14 side).

That is, the center of the housing of the fuel injection valve 11 is a large diameter portion 20, and the housing of the fuel injection valve 11 has, in order from the large diameter portion 20 toward the base end, a base end middle portion 26 that has a smaller diameter than the large diameter portion 20, a base end inserting portion 27 that has a smaller diameter than the base end middle portion 26, and a base end sealing portion 28 that has a smaller diameter than the base end inserting portion 27. A connector 26J that is connected to wiring for transmitting drive signals to an electromagnetic valve or the like housed in the fuel injection valve 11 in order to control fuel injection is provided on the base end middle portion 26. The base end sealing portion 28 supports the O-ring 29 through which it is inserted.

The O-ring 29 is formed in a generally toric (i.e., annular) shape by an elastic member such as rubber that is resistant to fuel. The O-ring 29 is also pressure resistant to the high-pressure fuel pressure. The inner periphery of the O-ring 29 closely contacts the outer peripheral surface of the base end sealing portion 28. Therefore, a seal that prevents high-pressure fuel from leaking between the fuel injection valve 11 and the O-ring 29 is obtained by the close contact between the inner periphery of the O-ring 29 and the outer peripheral surface of the base end sealing portion 28. Also, the outer periphery of the O-ring 29 is formed of a size so that it closely contacts the inner peripheral surface 14A of the fuel injection valve cup 14 of the delivery pipe 13. As a result, when the base end portion of the fuel injection valve 11 is inserted into the fuel injection valve cup 14 of the delivery pipe 13, the outer periphery of the O-ring 29 of the fuel injection valve 11 closely contacts the inner peripheral surface 14A of the fuel injection valve cup 14, thus providing a seal against high-pressure fuel. In this way, a fuel seal against the high-pressure fuel is able to be ensured between the fuel injection valve 11 and the fuel injection valve cup 14, by the seal between the O-ring 29 and the outer peripheral surface of the base end sealing portion 28, and the seal between the O-ring 29 and the inner peripheral surface 14A of the fuel injection valve cup 14.

Moreover, the housing of the fuel injection valve 11 also has, in order from the large diameter portion 20 toward the tip end, a medium diameter portion 21 that has a smaller diameter than the large diameter portion 20, and a small diameter portion 22 that has a smaller diameter than the medium diameter portion 21. The injection nozzle 23 that injects fuel is provided on the tip end of the small diameter portion 22. A seal portion 25 for maintaining the airtightness of the combustion chamber by ensuring a seal with the wall surface of the insertion hole 15 is provided to the base end side of the injection nozzle 23 on the small diameter portion 22.

A stepped portion based on the difference between the outer diameter of the large diameter portion 20 and the outer diameter of the medium diameter portion 21 is formed between the large diameter portion 20 and the medium diameter portion 21. A tapered surface 24 that is drawn (i.e., becomes narrower) toward the tip end side is provided on this stepped portion. That is, the tapered surface 24 of the fuel injection valve 11 faces, with a predetermined slant, the shoulder portion 18 positioned at the inlet portion 17 of the insertion hole 15 of the cylinder head 12 when the fuel injection valve 11 is inserted into the insertion hole 15. The angle of the tapered surface 24 with respect to a central axis (axis C) of the fuel injection valve 11 is, when represented as an angle with respect to an axis-parallel line C1 that is parallel to the axis C, preferably between 30° and 60°, inclusive, but may be selected from values greater than 0° and less than 90°.

An annular damping insulator 30 is provided between the tapered surface 24 of the fuel injection valve 11 and the shoulder portion 18 of the insertion hole 15. This damping insulator 30 is designed to absorb and suppress vibration that occurs in the fuel injection valve 11 based on fuel pressure fluctuation when there are fluctuations in the pressure of fuel supplied via the delivery pipe 13 due to fuel injection by the fuel injection valve 11 being started and stopped.

Figure 2:
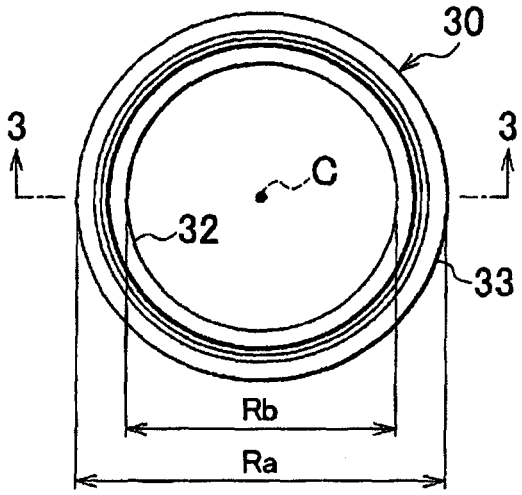
FIG. 2 is a plan view of a planar structure of the damping insulator according to this example embodiment.
Figure 3:
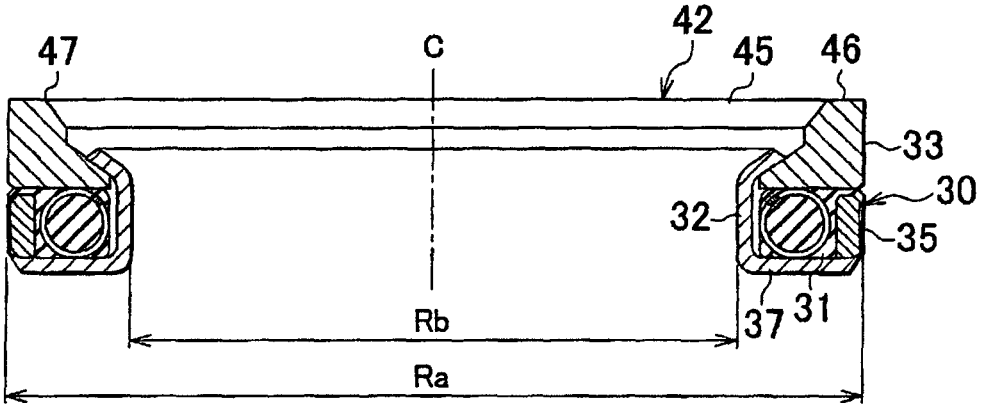
FIG. 3 is a sectional view of a sectional structure taken along line 3-3 in FIG. 2 of the damping insulator according to this example embodiment.

As shown in FIGS. 2 and 3, the damping insulator 30 has a toric (i.e., annular) shape with an outer diameter Ra and an inner diameter Rb. The outer diameter Ra of the damping insulator 30 is formed of a size that enables the damping insulator 30 to sit on the annular shoulder portion 18. Also, the inner diameter Rb of the damping insulator 30 is formed of a size that allows the medium diameter portion 21 of the fuel injection valve 11 to fit through the damping insulator 30 with some play between it and the damping insulator 30. As shown in FIG. 1, a ring 21R that has an outer diameter that is larger than the inner diameter Rb of the damping insulator 30 is provided on a tip end side portion of the fuel injection valve 11 of the medium diameter portion 21. The damping insulator 30 with the medium diameter portion 21 fit through it, is prevented from separating from the medium diameter portion 21 of the fuel injection valve 11 by this ring 21R.

As shown in FIG. 3, the damping insulator 30 includes an annular damping member 31, an annular plate 32 formed with a channel-shaped cross section so as to wrap around an inner peripheral portion (i.e., the axis C side in FIG. 3) and a lower portion (i.e., the lower side in FIG. 3) of the damping member 31, and an annular tolerance ring 33 provided on an upper portion (i.e., the upper side in FIG. 3) of the damping member 31. That is, the plate 32 has a plate bottom portion 37 on which the damping member 31 is stacked, and the tolerance ring 33 is further stacked on top of the damping member 31.

Figure 4:
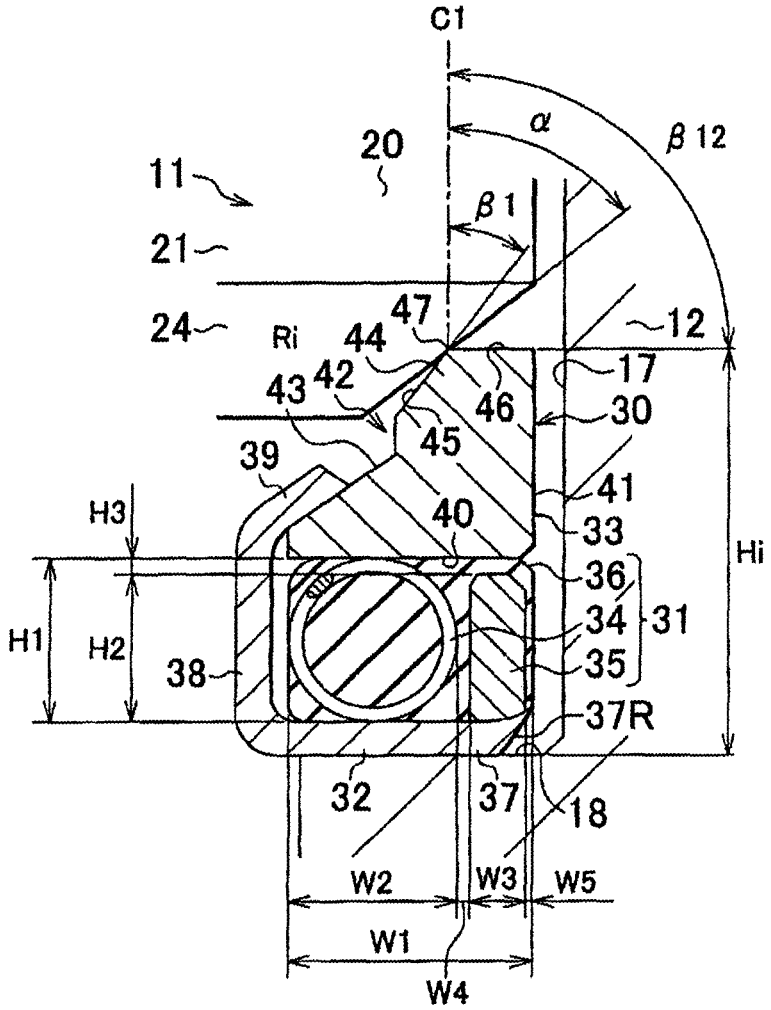
FIG. 4 is an end view of an end structure of the damping insulator according to this example embodiment.

As shown in FIG. 4, the damping member 31 is a member for absorbing and suppressing vibration of the fuel injection valve 11, and includes an annular coil spring 34, an annular sleeve 35 arranged to the outer peripheral side of the coil spring 34, and an elastic member 36 formed in an annular shape from rubber or the like in which the coil spring 34 and the annular sleeve 35 are integrally embedded. That is, the coil spring 34 is formed in the shape of a long helix-shaped body formed in a circle, curving so as to surround the fuel injection valve 11. FIG. 4 is a view showing one turn of the helix as a small ring portion of the coil spring 34. The helix of the coil spring 34 is formed by many of these turns being continuously connected together. FIG. 4 also shows a height H1 that is the helix diameter (i.e., the outer diameter of one turn) of the helix of the coil spring 34, and a width W2 that is the helix diameter (i.e., the outer diameter of one turn) of the helix. When the coil spring 34 is not being pressed on, the height H1 and the width W2 are approximately the same length, but when the coil spring 34 is pressed on in the vertical direction, the ring shape of the turn of the helix deforms such that the height becomes lower than the height H1 and the width becomes wider than the width W2, i.e., H1<W2. The coil spring 34 is made with stainless steel or spring steel typified by piano siring as the material.

With the main raw material of the elastic member 36 being fluoro-rubber, nitrile rubber, hydrogenated nitrile rubber, fluorosilicone rubber, or acrylic rubber, a filler such as carbon black, silica, clay, calcium carbonate or celite, and rubber that is a blend of an antioxidant, a processing aid, and a curing agent suitable for each rubber, or an elastomer such as TPE, or the like, is used as the material of the elastic member 36. The coil spring 34 is embedded inside the elastic member 36, so the height in the vertical direction is the height H1 that is the same as the height of the coil spring 34, and the width in the radial direction is a width W1 that includes the width W2 of the coil spring 34 and is wider than this width W2.

The sleeve 35 is more rigid than the coil spring 34, and is made from metal including iron and stainless steel and the like, or engineering plastic that is very rigid, for example. The sleeve 35 is formed in an annular shape and has a thickness of a width W3 in the width direction (i.e., the radial direction). The inner diameter of the sleeve 35 is large enough so that the sleeve 35 does not contact the coil spring 34 that is arranged on the inner peripheral side of the sleeve 35. Therefore, a gap W4 that is filled with the elastic member 36 is provided in the width direction (i.e., the radial direction) between the sleeve 35 and the coil spring 34. That is, the sleeve 35 is configured so as not to contact the coil spring 34. This reduces the possibility, of the vibration absorbing and damping characteristic of the coil spring 34 changing due to the coil spring 34 abutting against the sleeve 35. Thus, the damping member 31 is also able to have a good vibration absorbing and damping characteristic that is little affected by the sleeve 35. Also, the outer peripheral side of the sleeve 35 is covered by the elastic member 36 of a width W5 in the circumferential direction (i.e., the radial direction).

The sleeve 35 is such that a height H2 thereof is formed lower than an outer diameter (i.e., the height H1) of the helix diameter of a cross-section of the coil spring 34 (i.e., H2<H1), and the lower end in the vertical direction is aligned with the height of the lower end of the helix diameter of the coil spring 34. Therefore, a height H3 (=H1−H2) is provided between the sleeve 35 and the coil spring 34 on the upper side in the vertical direction, and the elastic member 36 of the height H3 is filled on the upper side of the sleeve 35 that is embedded in the elastic member 36. That is, the upper end side in the vertical direction of the sleeve 35 is buried in the elastic member 36. As a result, when the damping member 31 and the tolerance ring 33 are joined, the elastic member 36 of a thickness corresponding to the height H3 is arranged (i.e., interposed) between the upper side of the sleeve 35 and a ring bottom surface 40 of the tolerance ring 33.

In this way, the damping member 31 is given a characteristic suitable for absorbing and damping vibration in the fuel injection valve 11, based on the vibration absorbing and damping characteristic of the elastic member 36 and the vibration absorbing and damping characteristic of the coil spring 34.

The elastic member 36 and the coil spring 34 display a suitable vibration absorbing and damping characteristic by appropriate elastic deformation when a prescribed load at which elasticity can be maintained is applied. However, if a load that exceeds this prescribed load is applied, plastic deformation will occur and elasticity will be lost, resulting in the elastic member 36 and the coil spring 34 no longer being able to appropriately display the vibration absorbing and damping characteristic. That is, if the elastic member 36 and the coil spring 34 deform in a way in which they are crushed in the vertical direction by the pressing force of the fuel injection valve 11, the elastic member 36 and the coil spring 34 will freely deform while the deformation amount is equal to or less than a predetermined deformation amount, but if they deform beyond the predetermined deformation amount, the elastic member 36 and the coil spring 34 will end up plastic deforming. For example, even if a large pressing force is applied such that the height of the damping member 31 deforms from the height H1 to the height H2, appropriate elastic deformation of the damping member 31 will be maintained. That is, the predetermined deformation amount indicative of the boundary between elastic deformation and plastic deformation of the damping member 31 is the height H3. However, if the deformation amount exceeds the height H3 due to pressing force that exceeds the predetermined pressing force, such that the height of the damping member 31 deforms to become lower than the height H2, it is more likely that the appropriate elastic deformation will not be able to be maintained and the damping member 31 will end up plastic deforming.

Therefore, in this example embodiment, even if a load that exceeds a predetermined load is applied, the sleeve 35 will prevent the elastic member 36 and the coil spring 34 from excessively deforming, beyond the predetermined deformation amount (i.e., the height H3). That is, if the elastic member 36 and the coil spring 34 deform in a way in which they are crushed in the vertical direction by the pressing force of the fuel injection valve 11, the elastic member 36 and the coil spring 34 will deform freely while the deformation amount is equal to or less than the predetermined deformation amount. If a load that exceeds this predetermined deformation amount is applied or the like due to excessive pressing force or the like, the sleeve 35 will prevent deformation that exceeds the predetermined deformation amount of the elastic member 36 and the coil spring 34. Therefore, even if a large pressure is suddenly applied to the damping member 31, plastic deformation of the elastic member 36 and the coil spring 34 is prevented by the sleeve 35, so the elastic force of the elastic member 36 and the coil spring 34 can be maintained.

When the sleeve 35 prevents excessive deformation of the elastic member 36 and the coil spring 34, the sleeve 35 supports the vibration and the pressing force from the tolerance ring 33. At this time, the elastic member 36 that is arranged at the height H3 between the sleeve 35 and the tolerance ring 33 continues to be interposed as it is deformed. Therefore, the sleeve 35 and the tolerance ring 33 are prevented from directly contacting one another, so vibration transmitted from the tolerance ring 33 to the sleeve 35 is suppressed compared with when the sleeve 35 and the tolerance ring 33 directly contact one another.

The plate 32 is made of metal such as SUS430 that is stainless material that is easy to draw, for example. As shown in FIG. 4, the plate 32 is formed with a channel-shaped cross section, and includes the plate bottom portion 37, a plate inner wall portion 38 that extends from an inner peripheral side of the plate bottom portion 37 upward along the damping member 31, and a plate covering portion 39 that is bent from an upper end of the plate inner wall portion 38 toward the outer peripheral side so as to cover a portion of the inner peripheral portion of the tolerance ring 33. That is, the plate 32 integrally sandwiches the tolerance ring 33 and the damping member 31 from the inner peripheral side of the tolerance ring 33.

The damping member 31 contacts (i.e., presses against) the upper surface of the plate bottom portion 37, while the lower surface of the plate bottom portion 37 is abutted against the shoulder portion 18 of the insertion hole 15. As a result, the plate 32 maintains the ability to suitably slide in the cross direction with respect to the shoulder portion 18 of the insertion hole 15, while force from the damping member 31 and the like that is received by the plate 32 is distributed evenly to the annular shoulder portion 18. The shoulder portion 18 is part of the cylinder head 12 that is made of aluminum or the like, so the hardness of the shoulder portion 18 is less than that of the coil spring 34. Therefore, if the coil spring 34 were to directly contact the shoulder portion 18, it is possible that it may cause problems such as the portion of the shoulder portion 18 where the force is concentrated becoming chipped or deformed. However, in this example embodiment, the force from the coil spring 34 that is received by the plate 32 is dispersed and transmitted in the circumferential direction to the shoulder portion 18 via the annular plate bottom portion 37 that corresponds to the shoulder portion 18. Accordingly, the plate 32 prevents problems that may occur if the coil spring 34 directly contacts the shoulder portion 18.

A return portion 37R formed by press forming is formed on an end portion on the outer peripheral side of the plate bottom portion 37. That is, the return portion 37R is cut up at an angle toward the outer peripheral side from the bottom surface of the plate bottom portion 37. The damping insulator 30 is able to slide on the shoulder portion 18 and move to the outer peripheral surface of the inlet portion 17 from a position near the center of the step of the shoulder portion 18 that is distanced from the outer peripheral surface of the inlet portion 17. At this time, the plate bottom portion 37 of the damping insulator 30 will not catch or ride up on a portion that has been left rising up on the outer peripheral end of the shoulder portion 18 because the return portion 37R is provided. That is, the return portion 37R is formed in a shape such that it will not contact the portion that is left rising up on the outer peripheral end of the shoulder portion 18. A rise on the outer peripheral end of the shoulder portion 18 that is made so that the return portion 37R will not contact it may also be intentionally formed.

This kind of return portion 37R prevents the outer peripheral end of the plate bottom portion 37 from interfering with the portion that rises up on the outer peripheral end of the shoulder portion 18, even if the damping insulator 30 moves to abut against the outer periphery of the shoulder portion 18. That is, the return portion 37R prevents the movement characteristic of the plate 32 from decreasing due to the plate bottom portion 37 catching on the rising portion of the outer peripheral end of the shoulder portion 18. Furthermore, the return portion 37R prevents the position where the tolerance ring 33 abuts against the tapered surface 24 of the fuel injection valve 11 (i.e., the position of a height Hi from the shoulder portion 18 in FIG. 4) from changing due to the plate bottom portion 37 riding up on the rising portion and tilting.

The plate inner wall portion 38 is formed so as to rise up along the damping member 31 from the inner peripheral end of the plate bottom portion 37, and thus extends upward in a manner following the medium diameter portion 21 of the fuel injection valve 11.

The plate covering portion 39 extends such that the tip end portion of the plate inner wall portion 38 partially covers an inner peripheral slanted surface 42 of the tolerance ring 33 that is stacked on the damping member 31. Furthermore, the plate covering portion 39 abuts against the inner peripheral slanted surface 42 of the tolerance ring 33, and applies an outer peripheral side and downward force to the inner peripheral slanted surface 42. As a result, the plate covering portion 39 reinforces the connection between the tolerance ring 33 and the damping member 31, and prevents the relative position between the tolerance ring 33 and the damping member 31 from changing.

The tolerance ring 33 supports the fuel injection valve 11 with respect to the cylinder head 12, by abutting against the tapered surface 24 of the fuel injection valve 11. The tolerance ring 33 is made of metal such as stainless steel, e.g., SUS304 that is hard stainless material. The metal of which the tolerance ring 33 is made has a hardness equal to that of the tapered surface 24 of the fuel injection valve 11, but metal having a hardness equal to that of a member having another hardness, such as the coil spring 34, may also be used.

As shown in FIG. 4, the cross-section of the tolerance ring 33 has the generally trapezoidal shape of a chock block. That is, the tolerance ring 33 has the ring bottom surface 40 that is connected to the damping member 31, a ring outer peripheral surface 41 that is perpendicular to the ring bottom surface 40 on the outer periphery of the ring, a horizontal ring upper surface 46 from an upper end of the ring outer peripheral surface 41 toward the center of the ring, and the inner peripheral slanted surface 42 that forms a concave taper from the inner peripheral edge of the ring upper surface 46 toward the center of the ring. More specifically, the length of the ring upper surface 46 is shorter than the length of the ring bottom surface 40 in the radial direction, so the inner peripheral slanted surface 42 that connects the inner peripheral edge of the ring bottom surface 40 with the inner peripheral edge of the ring upper surface 46 forms a concave taper toward the center of the ring. The inner peripheral slanted surface 42 includes a connecting portion 43 and a tapered surface 45.

The ring bottom surface 40 abuts against the upper surface of the damping member 31. The ring bottom surface 40 disperses the pressing force from the fuel injection valve 11 that is received by the tolerance ring 33 in the circumferential direction along the entire annular ring bottom surface 40 and transmits that pressing force to the upper surface of the damping member 31, such that the pressing force is applied evenly to the damping member 31. As a result, problems such as the damping member 31 plastic deforming due to localized concentration of force are prevented from occurring.

The outer diameter of the ring outer peripheral surface 41 is formed to be substantially the same diameter as the outer diameter of the damping member 31, and the outer diameter Ra of the plate bottom portion 37 of the plate 32. That is, the outer diameter of the ring outer, peripheral surface 41 is set to be substantially the same as the outer diameter Ra of the damping insulator 30, so it will not constrict the movement range in the radial direction of the damping insulator 30 at the inlet portion 17 of the insertion hole 15. The height of the ring outer peripheral surface 41 is set to a height that is able to support the fuel injection valve 11 at a height Hi prescribed in advance as the distance from the shoulder portion 18 as the height at which to support the fuel injection valve 11. That is, the height from the shoulder portion 18 to the ring upper surface 46 that extends horizontally from the upper end of the ring outer peripheral surface 41 is also the height Hi.

The inner peripheral slanted surface 42 is provided between the inner peripheral edge of the ring bottom surface 40 and the inner peripheral edge of the ring upper surface 46. The connecting portion 43 is positioned on the inner side of the inner peripheral slanted surface 42 and abuts against the plate covering portion 39 of the plate 32. The tapered surface 45 is positioned on the outer side of the inner peripheral slanted surface 42 and faces the tapered surface 24 of the fuel injection valve 11. The tapered surface 45 and the ring upper surface 46 form an abutting portion 44 that faces the tapered surface 24 of the fuel injection valve 11. That is, the tapered surface 45 is a further tapered surface of the tolerance ring 33. Also, the connecting portion 43 is positioned to the inner peripheral side of the abutting portion 44, and a large portion of the connecting portion 43 does not face the tapered surface 24 of the fuel injection valve 11. More specifically, the inner peripheral edge of the connecting portion 43 is connected, via the inner peripheral surface of the tolerance ring 33, to the inner peripheral edge of the ring bottom surface 40. The plate covering portion 39 of the plate 32 is bent toward the outer peripheral side so as to abut against this connecting portion 43. That is, force to the outer peripheral side and downward (i.e., in the direction of the damping member 31) is applied from the plate covering portion 39 to the connecting portion 43. Therefore, the pressure contact of the tolerance ring 33 against the damping member 31 is reinforced, so the relative positional relationship with the damping member 31 is kept from changing.

A ridge line 47 (an apex in a sectional view) is formed at the connecting portion between the outer peripheral edge of the tapered surface 45 and the inner peripheral edge of the ring upper surface 46. An angle $\beta 1$ of the tapered surface 45 is set smaller than an angle $\alpha$ of the tapered surface 24 of the fuel injection valve 11. An angle $\beta 12$ of the ring upper surface 46 with respect to the axis-parallel line C1 is set larger than the angle $\alpha$ of the tapered surface 24, to a substantially right angle. Accordingly, the angle (i.e., the taper angle) $\beta 1$ of the tapered surface 45 and the angle (i.e., the taper angle) $\beta 12$ of the ring upper surface 46 are both different angles than the angle (i.e., the taper angle) $\alpha$ of the tapered surface 24 of the fuel injection valve 11, and the angle $\alpha$ is included between these angles $\beta 1$ and $\beta 12$ ($\beta 1<\alpha<\beta 12$). Therefore, the ridge line 47 that serves as the boundary line between the tapered surface 45 and the ring upper surface 46 appears as an apex that makes point contact with the tapered surface 24 of the fuel injection valve 11, so actually the ridge line 47 makes line contact with the tapered surface 24 of the fuel injection valve 11. Meanwhile, from this, the inner peripheral surface of the tolerance ring 33, the ring bottom surface 40, and the ring outer peripheral surface 41, that are all surfaces of the tolerance ring 33, form surfaces that do not face the tapered surface 24 of the fuel injection valve 11.

[Operation of the Damping Insulator]

With the damping insulator of this example embodiment, when pressing force is applied from the tapered surface 24 of the fuel injection valve 11, force in the direction along the axis-parallel line C1 (i.e., an axial component force of a load, i.e., an axial load) according to the angle $\alpha$ of the tapered surface 24 is applied to the ridge line 47 of the tolerance ring 33. The force in the direction along the axis-parallel line C1 is transmitted to the shoulder portion 18 via the damping member 31 and the plate 32. As a result, the fuel injection valve 11 enters the insertion hole 15 of the cylinder head 12 in response to the damping member 31 being press deformed by the pressing force from the fuel injection valve 11. In other words, the fuel injection valve 11 moves farther toward the tip end of (i.e., downward with respect to) the cylinder head 12, such that the height at which the fuel injection valve 11 is supported by the cylinder head 12 decreases, instead of being maintained at the height Hi.

However, the sleeve 35 of height H2 is embedded in the damping member 31, so the height of the damping member 31 will not become lower than the height H2. That is, the height at which the fuel injection valve 11 is supported by the cylinder head 12 is maintained higher than the difference of the height Hi minus the height 13. Also, the height H2 is a height that ensures a deformation amount of equal to or less than a predetermined deformation amount that enables the elastic deformation of the damping member 31 to be maintained. Thus, the sleeve 35 eliminates the possibility of the damping characteristic of the damping member 31 decreasing or the damping member 31 plastic deforming due to the damping member 31 deforming to a height that is lower than the height H2. As a result, the sleeve 35 restricts the deformation of the damping member 31 to between the height H1 and the height H2, and ensures that the damping member 31 suitably displays damping performance.

Also, even if the damping member 31 approaches the height H2, the elastic member 36 is interposed, even as it deforms, between the sleeve 35 and the tolerance ring 33. As a result, vibration of the fuel injection valve 11 that is transmitted from the tolerance ring 33 to the sleeve 35 is also suppressed to some degree by the elastic member 36 that is interposed. That is, the possibility that vibration of the fuel injection valve 11 will result in abnormal noise emanating from the internal combustion engine, or cause a knock sensor of the internal combustion engine to malfunction is minimized.

Furthermore, the inner peripheral surface of the sleeve 35 will not contact the coil spring 34 even if the coil spring 34 is pressed to the height H2. Therefore, the possibility of the vibration absorbing and damping characteristic of the coil spring 34 changing due to the coil spring 34 contacting the sleeve 35 is eliminated. Thus, the damping member 31 is able to display a suitable vibration absorbing and damping characteristic with little effect from the sleeve 35.

Also, when the damping member 31 approaches the height H2, the sleeve 35 transmits the pressing force of the fuel injection valve 11 to the shoulder portion 18 of the insertion hole 15 via the upper surface of the plate bottom portion 37. Therefore, the ability of the plate 32 to suitably slide in the cross direction with respect to the shoulder portion 18 of the insertion hole 15 is maintained, and the pressing force of the sleeve 35 is distributed evenly to the shoulder portion 18 via the plate 32. As a result, problems such as the shoulder portion 18 becoming chipped or deformed due to the sleeve 35 that has a higher hardness than the shoulder portion 18 directly contacting the shoulder portion 18 that is made of aluminum or the like as part of the cylinder head 12 will not occur.

As described above, the damping insulator of this example embodiment is able to yield the effects listed below.

(1) The coil spring 34 may also largely deform from pressure or the like, such that the position of the fuel injection valve 11 is maintained by the sleeve 35. At this time, at least one of the tolerance ring 33 side and the shoulder portion 18 side of the sleeve 35 is buried in the elastic member 36, so the elastic member 36 is interposed together with the sleeve 35 between the fuel injection valve 11 and the cylinder head 12. As a result, vibration transmitted from the fuel injection valve 11 to the cylinder head 12 via the sleeve 35 can be reduced by the elastic member 36 that is interposed midway along this path. That is, even if the coil spring 34 largely deforms, the position of the fuel injection valve 11 is able to be maintained by the sleeve 35, and vibration transmitted to the internal combustion engine is also able to be suppressed. As a result, even when the position of the fuel injection valve 11 is maintained by the sleeve 35, vibration transmitted from the fuel injection valve 11 to the internal combustion engine is suppressed, so noise that emanates from the internal combustion engine due to transmitted vibration is reduced, and erroneous detection by a knock sensor of the internal combustion engine of transmitted vibration as knocking and the like is suppressed.

(2) Excessive deformation that leads to plastic deformation of the coil spring 34 that may deform so much that it may undergo plastic deformation when it receives strong pressing force from the fuel injection valve 11 can be reliably prevented. As a result, the damping characteristic of the damping insulator 30 can be suitably maintained.

(3) The coil spring 34 and the sleeve 35 are maintained in a state in which they do not contact each other, so interference by the sleeve 35 with respect to the coil spring 34 is reduced. Accordingly, the possibility that the damping characteristic given to the coil spring 34 will change due to interference by the sleeve 35 is reduced. As a result, the damping characteristic of the damping insulator 30 can be suitably maintained.

(4) Positioning the sleeve 35 on the outer peripheral side of the coil spring 34 enables the coil spring 34 to be made smaller. Also, arranging the sleeve 35 on the outside enables the size of the sleeve 35 to be large enough so that it will not fall into the insertion hole of the cylinder head 12.

(5) The tolerance ring 33 side of the sleeve 35 is buried in the elastic member 36, so the elastic member 36 is interposed between the sleeve 35 and the tolerance ring 33. As a result, vibration transmitted from the fuel injection valve 11 to the tolerance ring 33 is transmitted to the sleeve 35 after being suppressed by the elastic member 36. Thus, the transmission of vibration from the sleeve 35 to the internal combustion engine is also suppressed, so the transmission of vibration from the fuel injection valve 11 to the internal combustion engine is able to be suppressed even when the fuel injection valve 11 is supported by the sleeve 35.

(6) The tolerance ring 33 and the elastic member 36 are integrally sandwiched by the plate 32, so the relative position, with respect to the elastic member 36, of the tolerance ring 33 that is not easily strongly joined to the elastic member 36 is determined from the inner peripheral surface by the plate 32. Accordingly, the tolerance ring 33 is easily stacked appropriately on the elastic member 36, which enables the operability (i.e., the feasibility) of this kind of damping insulator 30 to be improved.

Next, other example embodiments other than the example embodiment described above will be described. The invention may also be carried out by example embodiments such as those described below, for example.

Figure 5:
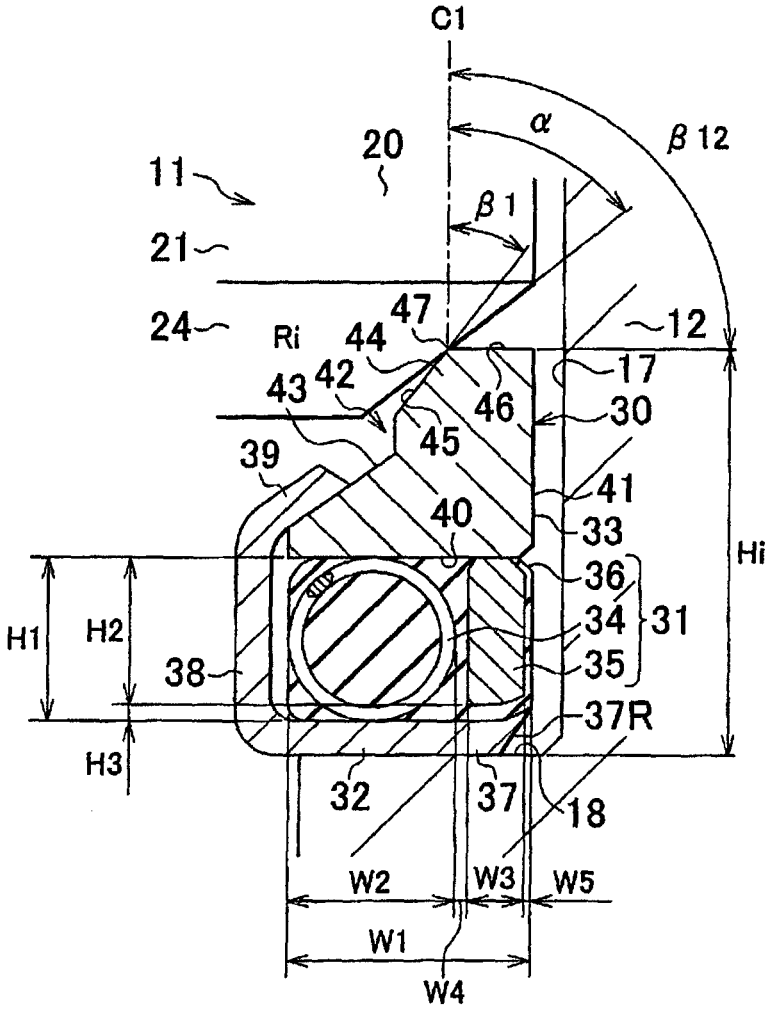
FIG. 5 is an end view of an end structure of another example embodiment of the damping insulator according to the invention.

In the example embodiment described above, a case is described in which the elastic member 36 is interposed between the ring bottom surface 40 and the sleeve 35. However, the invention is not limited to this. That is, the elastic member may also be interposed between the sleeve and the plate bottom portion. For example, as shown in FIG. 5, the elastic member 36 of the height H3 may be interposed between the sleeve 35 and the plate bottom portion 37, by aligning the height of the upper end of the coil spring 34 of the height H1 with the height of the upper end of the sleeve 35 of the height H2. That is, the lower end side in the vertical direction of the sleeve 35 may be buried in the elastic member 36. This also enables vibration transmitted from the sleeve 35 to the shoulder portion 18 via the plate bottom portion 37 to be suppressed by the elastic member 36 between the sleeve 35 add the plate bottom portion 37, even if the height of the damping member 31 deforms so as to approach the height H2. As a result, the degree of freedom in the structure of the damping insulator is able to be increased.

Figure 6:
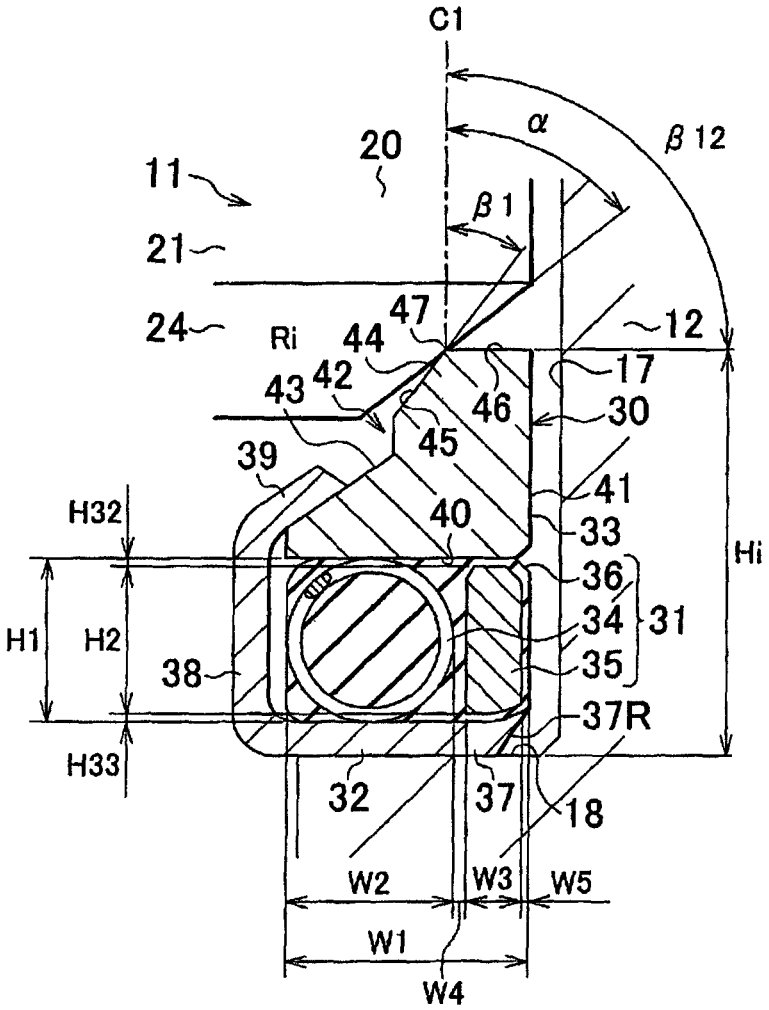
FIG. 6 is an end view of an end structure of yet another example embodiment of the damping insulator according to the invention.
Figure 7:
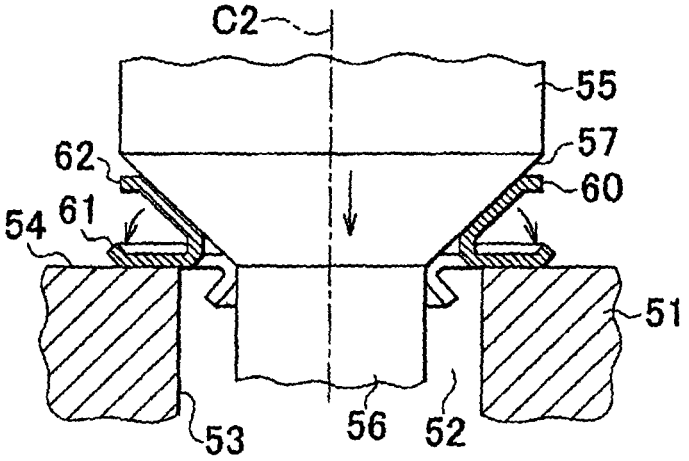
FIG. 7 RELATED ART
FIG. 7 is a sectional view of a sectional structure of a damping insulator according to related art.

Also, the elastic member may be interposed both between the ring bottom surface and the sleeve, and between the sleeve and the plate bottom surface. For example, as shown in FIG. 6, the elastic member 36 of a height H32 may be interposed between the ring bottom surface 40 and the sleeve 35, and the elastic member 36 of a height H33 may be interposed between the sleeve 35 and the plate bottom portion 37, by aligning an intermediate position in the vertical direction of the coil spring 34 of the height H1 with an intermediate position in the vertical direction of the sleeve 35 of the height H2. That is, the lower end side and the upper end side in the vertical direction of the sleeve 35 may both be buried in the elastic member 36. This also enables vibration transmitted from the ring bottom surface 40 to the shoulder portion 18 to be suppressed by the elastic members 36 between the ring bottom surface 40 and the sleeve 35, and between the sleeve 35 and the plate bottom portion 37, even if the height of the damping member 31 deforms so as to approach the height H2. As a result, the degree of freedom in the structure of the damping insulator is able to be increased.

In the example embodiment described above, a case is described in which the inlet portion 17 is formed the required minimum size for the damping insulator 30 to move for axial compensation. However, the invention is not limited to this. That is, the inlet portion may also be formed larger than the required minimum size for the damping insulator to move for axial compensation.

In the example embodiment described above, a case is described in which the angle β12 of the ring upper surface 46 is an angle that is substantially a right angle (i.e., 90°) with respect to the axis-parallel line C1. However, the invention is not limited to this. That is, the angle of the ring upper surface may also be an angle that is less than 90° with respect to the axis-parallel line C1. This also enables a ridge line to be formed by the ring upper surface and the tapered surface. As a result, the degree of design freedom for the tapered surface and the ring upper surface is increased, and the degree of design freedom for the ridge line is also increased. Hence, the degree of design freedom for this kind of damping insulator is able to be increased.

The various heights H1 to H3 in the example embodiment described above may be set as stated below. For example, the height H1 of the damping member 31 (i.e., the elastic member 36) may be set to 1.75 mm, the height H2 of the sleeve 35 may be set to 1.6 mm, and the height H3 at which the elastic member 36 is interposed may be set at 0.15 mm. The height H3 may also be adjusted to be 0.15 mm±0.1. This kind of adjustment also applies to the other heights. In this way, the height H3 at which the elastic member is interposed need simply be equal to or less than ¼ of the height H1 of the damping member, and more preferably, equal to or less than 1/10 of the height H1 of the damping member.

In the example embodiment described above, a case is described in which the sleeve 35 is arranged on the outer peripheral side of the coil spring 34, but the invention is not limited to this. That is, the sleeve may also be arranged on the inner peripheral side of the coil spring. Therefore, the degree of design freedom for the damping insulator is able to be increased.

In the example embodiment described above, a case is described in which the coil spring 34 and the sleeve 35 are distanced from one another, but the invention is not limited to this. That is, the coil spring may also be contacting the sleeve, or able to contact the sleeve.

In the example embodiment described above, a case is described in which the plate bottom portion 37 is provided between the damping member 31 and the shoulder portion 18, but the invention is not limited to this. That is, as long as the fuel injection valve is able to be suitably supported with respect to the shoulder portion, the plate bottom portion does not have to be provided between the damping member and the shoulder portion. Therefore, the degree of design freedom for the damping insulator is able to be increased.

The internal combustion engine to which the invention may be applied may be a gasoline engine or a diesel engine, as long as it is an in-cylinder injection type internal combustion engine.

The invention claimed is:

1. A fuel injection valve damping insulator that damps vibration produced in a fuel injection valve, the fuel injection valve being installed in a cylinder head in a state inserted into an insertion hole provided in the cylinder head, a shoulder portion being formed widening out in an annular shape at an inlet portion of the insertion hole, the fuel injection valve including a stepped portion in which a diameter thereof increases in a tapered shape so as to have a tapered surface that faces the shoulder portion, and the damping insulator being interposed between the stepped portion and the shoulder portion, the fuel injection valve damping insulator being by comprising:

a tolerance ring that is an annular shape that abuts against the tapered surface; and an elastic member that is arranged between the tolerance ring and the shoulder portion, wherein the elastic member is formed in an annular shape corresponding to a bottom surface of the tolerance ring to damp vibration produced in the fuel injection valve;

a coil spring that is arranged in an annular shape corresponding to the annular shape of the elastic member, and an annular sleeve that is juxtaposed to the coil spring, are embedded in the elastic member; and the sleeve is such that a height thereof is formed lower than an outer diameter of individual small ring portions that form a helix of the coil spring, and at least one of the tolerance ring side and the shoulder portion side of the sleeve is buried in the elastic member.

2. The fuel injection valve damping insulator according to claim 1, wherein a rigidity of the sleeve is higher than a rigidity of the coil spring.

3. The fuel injection valve damping insulator according to claim 1, wherein the height of the sleeve and a length of the outer diameter of the small ring portions are set to values at which plastic deformation of the coil spring and the elastic member will not occur with a deformation amount of equal to or less than a difference in length between a height of the sleeve and the outer diameter of the small ring portions before deformation, when the coil spring and the elastic member are deformed.

4. The fuel injection valve damping insulator according to any one of claim 1, wherein the coil spring and the sleeve are maintained in a state in which the coil spring and the sleeve do not contact each other, and are embedded in the elastic member.

5. The fuel injection valve damping insulator according to any one of claim 1, wherein the sleeve is positioned on an outer peripheral side of the coil spring.

6. The fuel injection valve damping insulator according to any one of claim 1, wherein the tolerance ring side of the sleeve is buried in the elastic member.

7. The fuel injection valve damping insulator according to any one of claim 1, wherein the shoulder portion side of the sleeve is buried in the elastic member.

8. The fuel injection valve damping insulator according to any one of claim 1, further comprising:

an annular metal plate that is interposed between the elastic member and the shoulder portion, and is configured to integrally sandwich the tolerance ring and the elastic member from an inner peripheral side of the tolerance ring.

* * * * *